US005366426A

United States Patent [19]

Glavin

[11] Patent Number: 5,366,426

[45] Date of Patent: Nov. 22, 1994

[54] SWIMMING EXERCISER WITH IMPROVED LEG MOTION

[76] Inventor: James P. Glavin, Old Chase, The Avenue, Godalming, Surrey GU7 1PE, United Kingdom

[21] Appl. No.: 147,967

[22] Filed: Nov. 5, 1993

[51] Int. Cl.[5] ..... A63B 69/10

[52] U.S. Cl. ..... 482/56; 482/127; 482/126; 482/142

[58] Field of Search ..... 482/55, 56, 79, 126, 482/142, 80, 139, 127

[56] References Cited

U.S. PATENT DOCUMENTS 3,731,921 5/1973 Andrews, Jr. .
4,537,396 10/1985 Hooper .
4,830,363 5/1989 Kennedy .
4,844,450 7/1989 Rodgers, Jr. .
4,948,119 9/1990 Robertson .
5,072,929 12/1991 Peterson et al. .
5,147,265 9/1992 Pauls et al. .
5,158,153 10/1992 Reeves .

*Primary Examiner*—Richard J. Apley
*Assistant Examiner*—Lynne A. Reichard

[57] ABSTRACT

An exercise apparatus enables users to very closely approximate the workout and training experience of actual swimming by the use of two functional features. An open hip adjustable bench design supports the users body in a manner that is similar to the dynamic buoyancy of water. A leg exercise portion of the apparatus gives an unrestricted leg movement with force resistance vectors equivalent to those provided by water. The apparatus is also convenient to use and can be stored away for use at the home as well as a gym.

18 Claims, 4 Drawing Sheets

SWIMMING EXERCISER WITH IMPROVED LEG MOTION

BACKGROUND OF THE INVENTION

1. Field of the Invention

This invention relates generally to exercise apparatus. More specifically this invention relates to exercise apparatus for simulating swimming.

2.Description of the Prior Art

The prior art discloses a variety of swimming apparatus. The prior art generally shows a bench or support for a person to lay in a principally horizontal position while the user moves their arms and legs in manner that to lesser or greater degrees simulate swimming. It is important that the bench have a fully cantilevered arrangement since the arms of the user may extend as much as 8 to 12 inches below the user's hips when executing a full swimming stroke. U.S. Pat. No. 4,844,450 discloses a swimming device that uses a cantilevered bench which improves arm motion and overrunning clutch assemblies to provide leg and arm resistance through a series of cables for the arms and levers for the legs. The overrunning clutch assembly uses a single flywheel with overrunning clutches to power the flywheel by the cables on the power stroke and springs to return the cables on the return stroke.

According to long standing principles of swimming a proper swimming stroke incorporates large amounts of torso rotation to cut water resistance and increase arm stroke efficiency. Corresponding head rotation accompanies the torso rotation. The use of large flat support benches as shown in U.S. Pat. No. 4,844,450 do not readily permit natural torso or head rotation.

U.S. Pat. No. 5,158,513 discloses a simulated swimming apparatus that again consists of an arrangement of overrunning clutches, pulleys, flywheels, recoil handles and springs for providing arm resistance. The apparatus of U.S. Pat. No. 5,158,513 uses a pivotable cantilever body support to facilitate rolling of the body and a radial pivoting chin support to allow side to side head movement. The rolling motion produced by the pivoting members aids in approximating the torso and head rotation of swimming motion but requires a complicated and often uncomfortable torso and head support.

When actually swimming the speed of the swimmer will also change the swimmers body displacement and attitude with respect to the water. As the swimmers speed increases more lift is experienced and the body rises out of the water. This decreased body displacement does not occur evenly. Since the hips represent a heavier part of the body, the swimmer's head and shoulders elevate with respect to the rest of the body. Most of the available swimming devices do not allow adjustment of the torso support in a manner that will simulate changes in swimming speed by adjusting torso attitude.

U.S. Pat. No. 4,830,363 discloses a device for simulating swimming that uses individual biased pulleys for the arm motion. U.S. Pat. No. 4,830,363 describes a bench having an adjustable center point but does not provide a cantilevered bench to avoid restriction of arm movements. The bench also adjusts in the middle which does not permit the body to slant downward from the head to the hips. A great deal of attention has been focused on arm and body motions, but the leg motion has received little attention. The kicking motion is important to achieve the full conditioning benefit of swimming. In actual swimming kicking provides only about 20% of the propulsion during a distance swim. However, kicking consumes a large portion of the available oxygen. Thus, while kicking may have lesser importance for propulsion, kicking is a vital part of swimming when it is used as an aerobic exercise. Since the legs comprise such large muscle groups, the limited motion that kicking demands actually creates a large a portion of the oxygen debt produced by the person performing the exercise and burns a lot of calories in the process. Although most of the swimming exercise machines make some provision for leg exercise, the movements poorly approximate actual leg movement during swimming. Previously discussed U.S. Pat. Nos. 4,844,450, 5,158,513 and 4,830,363 all restrain the legs to a rigid swinging motion about a horizontal axis. The axis of rotation in these devices is offset from the hip rotation point of the user. This offset, usually in excess of 2 inches creates and eccentric motion that causes the leg to slide on the support surface. In such an arrangement the foot will slide along the support approximately 2½ inches for foot of vertical rise. Thus the bottom of the leg cannot be attached to the support for a secure feeling and the sliding motion of the leg creates discomfort for the user.

In addition to the fixed hinge support, the system of U.S. Pat. No. 4,830,363 (discussed above) uses pistons to resist leg movement. Piston like devices usually have a location that creates a leg resistance in a direction greatly different from that encountered during the natural kicking motion of swimming.

U.S. Pat. No. 3,731,921 uses fixed guides to provide resistance and support for a kicking motion. The guides again constrain the legs in a restricted fashion that is unlike the natural motion of kicking.

A swimming machine that offers a lesser degree of leg restraint while permitting some form of kicking motion is U.S. Pat. No. 4,948,119. This patent seats the user in an upright position. Pulleys mounted overhead give the user of this device a full range of arm motion. Lower pulleys having cable ends strapped to the legs pull outwardly on the legs. Although the legs have greater freedom for kicking, the force direction exerted on the legs by the pulley is much different than that encountered in normal swimming.

In addition to closely approximating swimming it is highly desirable for the apparatus to permit compact storage of the fully cantilevered bench arrangement. The typical frame structure of cantilevered swim exercise machines makes collapsing of the apparatus impractical.

Accordingly it is an object is to provide swimming simulation apparatus having a simplified bench that approximates the swimming motion of the torso and chin without obstructing arm movements.

Another object of this invention is to provide a swimming simulation apparatus that allows adjustment of the upper torso support in manner that resembles the changes in buoyancy that occur with actual swimming activity.

A further object of this invention it is to provide leg exercise in an exercise machine for simulating swimming that more closely approximates the actual leg movements associated with swimming than that offered by the prior art.

A yet further object of this invention is to provide a swimming simulation apparatus with a cantilevered bench that collapses to a compact form for storage.

BRIEF SUMMARY OF THE INVENTION

This invention is an exercise apparatus for the simulation of swimming that enables users to very closely approximate the workout and training experience of actual swimming with an apparatus that is convenient to use and can be stored away for use at the home as well as a gym. The close approximation to real swimming is achieved two discoveries. One discovery is an open hip adjustable bench design that supports the users body in a manner that is similar to the dynamic buoyancy of water. A second discovery is a leg exercise apparatus that gives an unrestricted leg movement with force resistance vectors equivalent to those provided by water.

The swimmer support bench provides both a hip cut away portion and an attitude adjustment to lift the front of the users body. Attitude or angle adjustment of the bench is designed to fix the back of the bench and allow raising of the front portion of the bench. Adjusting the bench to increase or decrease the elevation of the head and chest with respect to the rest of the body puts the body at an angle similar to that imposed by the buoyancy of the water.

The hip cut away of the bench provides support from above the buttocks portion of the hips on the pelvic portion of the user's body. This type of support leaves the natural hinge point of the hips unrestricted. Unrestricted hinge flexure works in conjunction with the leg apparatus to provide comfortable kicking with a water-like resistance.

A leg attachment that connected by a cable to a pulley system or other device resists leg motion along a line and in a manner that feels much like the resistance from water. The force vector produced by the leg resistance acts along a line perpendicular to the primary axis of the leg. Leg motion freedom associated with the cable support enables user to do a variety of kicks. The cable resistance can act independently to permit the user to employ a flutter kick as in the crawl or back stroke or a dolphin kick as used in the butterfly stroke. Other suitable cable resistance mechanisms can operate interchangeably to permit asynchronous leg movement as employed in the flutter kick or synchronous leg movement as employed in the dolphin kick.

Accordingly, this invention in one embodiment is an exercise apparatus for simulating a swimming motion. The apparatus comprises a substantially horizontal bench for supporting a person in a prone position having a front and back end; a pair of hand attachments secured to the user's hands; a pair of cables attaching each of the hand attachments to a resistance pulley located ahead of the front of the bench to provide abduction resistance to arm movement when a user's arm is extended above the shoulder and extensive resistance to arm movement when the user's arm is below the shoulders; a pair of leg supports; and, means for providing resistance to downward movement of the leg supports. The means for resistance resists downward movement when a user's legs are moved together in a synchronized motion and out of phase when a user's legs are moved out of phase in a synchronized or unsynchronized motion. The means for providing leg resistance also acts in a direction that is primarily transverse to the length of the leg.

In another embodiment this invention is again an exercise apparatus for simulating a swimming motion. bottom of the apparatus comprises a pair of spaced apart bottom rails. A first resistance device is secured to a forward portion of the spaced apart bottom rails and comprises a lower resistance sheave mounted on a first shaft, a pair of lower pulleys located on opposite sides of the first shaft, an arm cable connected to each lower pulley, a recoil mechanism to wind the cable around each arm pulley, an overrunning clutch for turning the first shaft in a single direction when unwinding said arm cable, and a means for securing the arm cables to a user's hands. Vertically extendable members fixed to a rearward portion of each of the spaced apart bottom rails provide a pair of vertical rails. A substantially horizontal bench, for supporting a person in a prone position, has a back end fixed with respect to the vertical members, a front end, means for adjustably elevating the front end of the bench with respect to the back end of the bench, and a U-shaped cut out for receiving the hips of a user defined by the back end of the bench. A horizontally extendable member is fixed to each of the vertically extendable members and adapted to extend in a rearward direction with respect to the spaced apart bottom rails to provide a pair of spaced apart top rails located above the bench. A second resistance device is secured to a rearward portion of the spaced apart top rails and comprises an upper resistance sheave mounted on a second shaft, a pair of upper pulleys located on opposite sides of the second shaft, a leg cable connected to each upper pulley, a recoil mechanism to wind the leg cable around each leg pulley, an overrunning clutch for turning the second shaft in a single direction when unwinding the leg cable; and a pair of leg supports attached to opposite ends of the leg cables for attachment to the lower leg or foot of the user.

In addition, the exercise apparatus described herein embodies other features that aid in its approximation of real swimming and make it more convenient to use than other exercise machines for simulating swimming. One such feature includes a pivotable chin support incorporated into the bench to support the user's head while permitting easy and comfortable rotation of the head. The apparatus also can have an arrangement that permits it to be easily broken down into a compact unit for storage. Other features that make the exercise apparatus easy to use are described in the following detailed description of the invention.

DETAILED DESCRIPTION OF THE INVENTION

Figure 1:
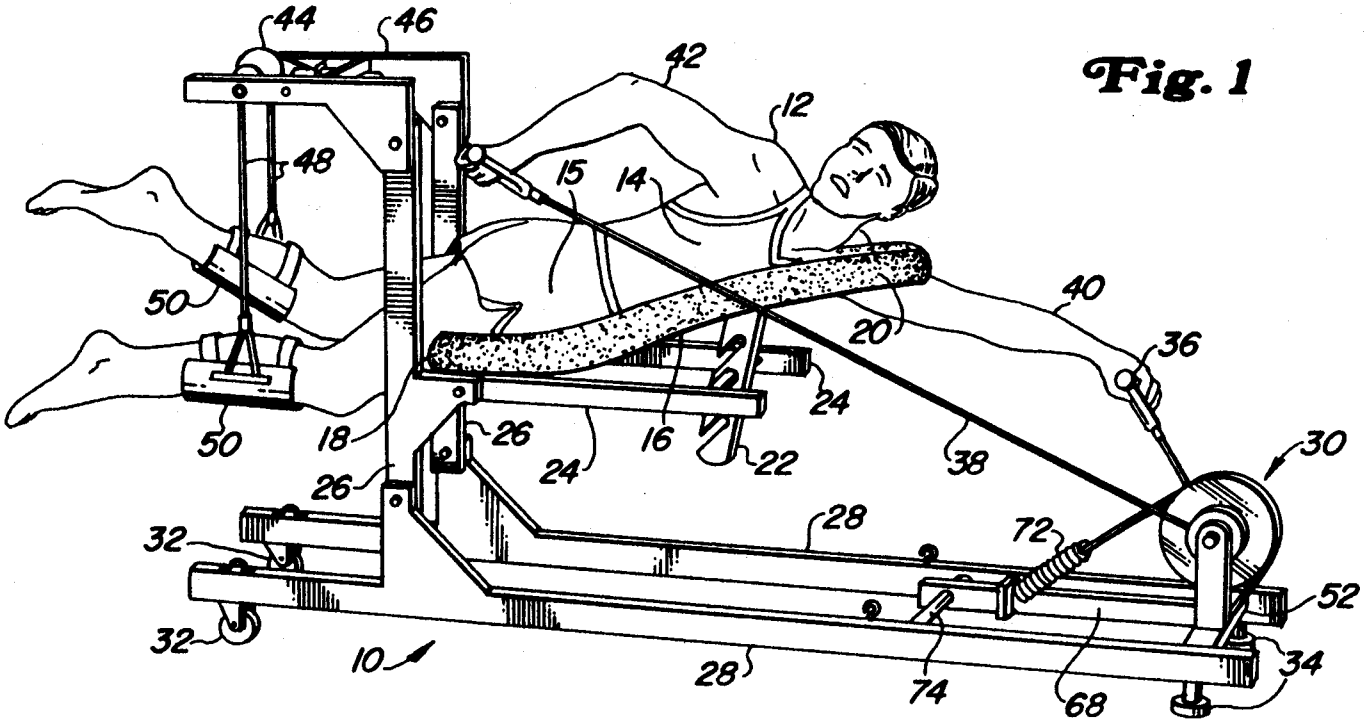
FIG. 1 is a three dimensional view showing the swim apparatus and a user of the swim apparatus.

Referring to FIG. 1, one form of the simulated swimming apparatus 10 of this invention is disclosed with a user 12 engaged in exercise thereon. A bench 16 support the chest 14 and pelvic area 15 of the user. The bench maintains the user in a prone position. Bench 16 extends in a substantially horizontal direction from the back 18 of bench 16. The substantially horizontal position of the bench includes the orientation of the bench at an incline such that the front 20 of bench 16 has an upward attitude. The upward attitude may be adjusted within a range of from 0 to 45 degrees from the horizontal by a means for elevating the front of the bench such as a slotted adjustment bar 22.

Slotted adjustment bar 22 and the back 18 of the bench are both supported by a pair of horizontally extended members. Horizontal members 24 together support the bench 16 in cantilevered fashion to leave the space ahead of bench 16 open for unobstructed movement of the users arms. Typically the horizontally extendable members 24 comprise a pair of spaced apart middle rails. A pair of vertical support rails consisting of vertically extendable members 26 together support horizontal members 24.

Vertically extendable members 26 and resistance device 30 are all supported from a pair of spaced apart bottom rails 28. Bottom rails 28 extend are parallel to each other. The bottom rails may have continuous contact the ground or may be spaced above the ground by coasters 32 and adjustable legs 34.

Resistance device 30 is located on a forward portion of the support rails ahead of user 12. When using the apparatus user 12 grasps a handle 36 with each hand or has a hand attachment device secured to each hand. A cable 38 connects each handle or hand attachment device with the resistance device 30 to provide abductive resistance followed by extensive resistance as a user's arm moves from a position above the user's shoulders to a position below the user's shoulders. FIG. 1 depicts arm 40 of the user extended above the user's shoulders in a position for extensive resistance and arm 42 of the user below the user's shoulders in a position for abductive resistance.

Another friction device 44 resists downward movement of the user's legs. Preferably vertical rails 26 support a horizontally extendable members 46 that extend to the rear of the apparatus to together provide a pair of top rails located above bench 16. A pair of cables 48 depend from friction device 44 and are each coupled to a leg support 50.

Leg supports 50 receive the users legs. Any suitable attachment device can be used to attach the end of cable 48 to the users legs. Preferably the attachment device will attach below the users knee and more preferably the attachment device will attach on the lower part of the users leg and provide a sleeve for extended support. Attachment 50 wraps around the users shin and is buckled or strapped to the user. Leg supports 50 depicted in FIG. 1 are can be made of rigid, flexible or semi-flexible materials. Flexible plastic or canvass are preferred and can provide suitable material for wrapping around the front of the users shin.

The users legs are otherwise unrestricted from lateral movement by the leg supports 50. The cable act in a direction that is generally transverse to the length of the users legs to provide a resistive force vector that acts in an upward direction. The direction of the resistive force vector and the lateral freedom of the legs allow the users legs to assume a very natural kicking position.

The friction device 44 can consist of any suitable device that will resist the downward movement of the user's legs when executing a simulated a flutter or dolphin kick. Preferably the friction device will provide downward resistance for synchronous and asynchronous downward leg movement so that the user may use the exercise device to simulate both flutter and dolphin style kicks.

Friction devices that are useful for this invention are well known to those skilled in the art. Typical friction devices having the desired characteristics for use in this invention are described in U.S. Pat. Nos. 4,537,396, 5,147,265 and 5,072,929 that generally relate to fan and/or clutch pull cord devices that can be used to provide resistance for numerous different kinds of exercise. These patent specifically disclose devices that use a friction sheave, an overrunning clutch, and a recoil spring to rewind cable about a recoil pulley that drives the sheave.

Figure 2:
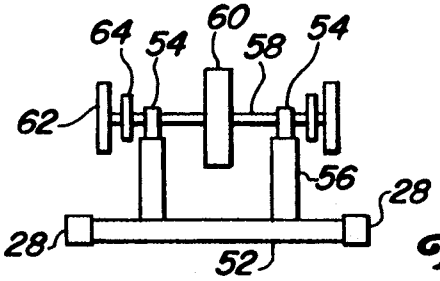
FIG. 2 is a schematic front view of the arm resistance mechanism of this invention.

Basic elements of the preferred resistance device for this invention are schematically shown in FIG. 2. Figure 2 depicts friction device 30 held between bottom rails 28 by a cross bar 52. A journal 54 supported from cross bar 52 rotatably retains a shaft 58 in bearing assembly. Shaft 58 retains a sheave in the form of flywheel 60 in a fixed central position. The ends of shaft 60 rotatably support a recoil pulley 62 at each end. The arm cables (not shown) are wrapped about pulley 62 by a recoil mechanism when the user releases the arm cable. A pull on either of the arm cables by the user unwind the cable from the pulley thereby driving the flywheel through the shaft and an overrunning clutch 64. Overrunning clutch 64 permits the recoil mechanism of the pulley to collect slack cable as the user releases the cable without interfering with the driving of flywheel 60 by either pulley.

Figure 3:
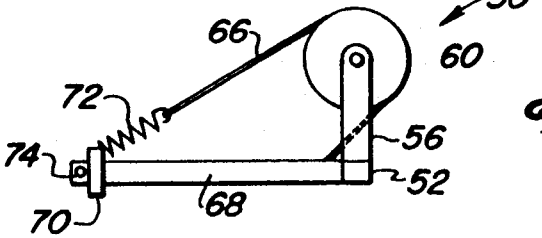
FIG. 3 is a schematic side view of the arm resistance mechanism of FIG. 2.

As depicted in FIG. 3 by a side view of FIG. 2, a strap 66 fixed to a center bar 68 allow adjustment of the force required to drive flywheel 60. Strap 66 wraps around pulley 60 and frictionally restrains the rotation of pulley 60. The opposite end of pulley 60 attaches eccentrically to the top of a square washer 70. Movement of the square washer toward or away from pulley 60 along center bar 68 decreases or increases the frictional resistance of pully 60. Adjustment of the strap tension is facilitated by the use of an elastomeric material for the strap or the addition of the spring 72 along the path of the strap. The eccentric force on washer 70 maintains the a desired amount of tension in strap 66 by holding the washer in place along center bar 68. Center bar 68 is secured at its front end to cross bar 52 and supported at the back by a rod 74 that straddles bottom rails 28.

Figure 4:
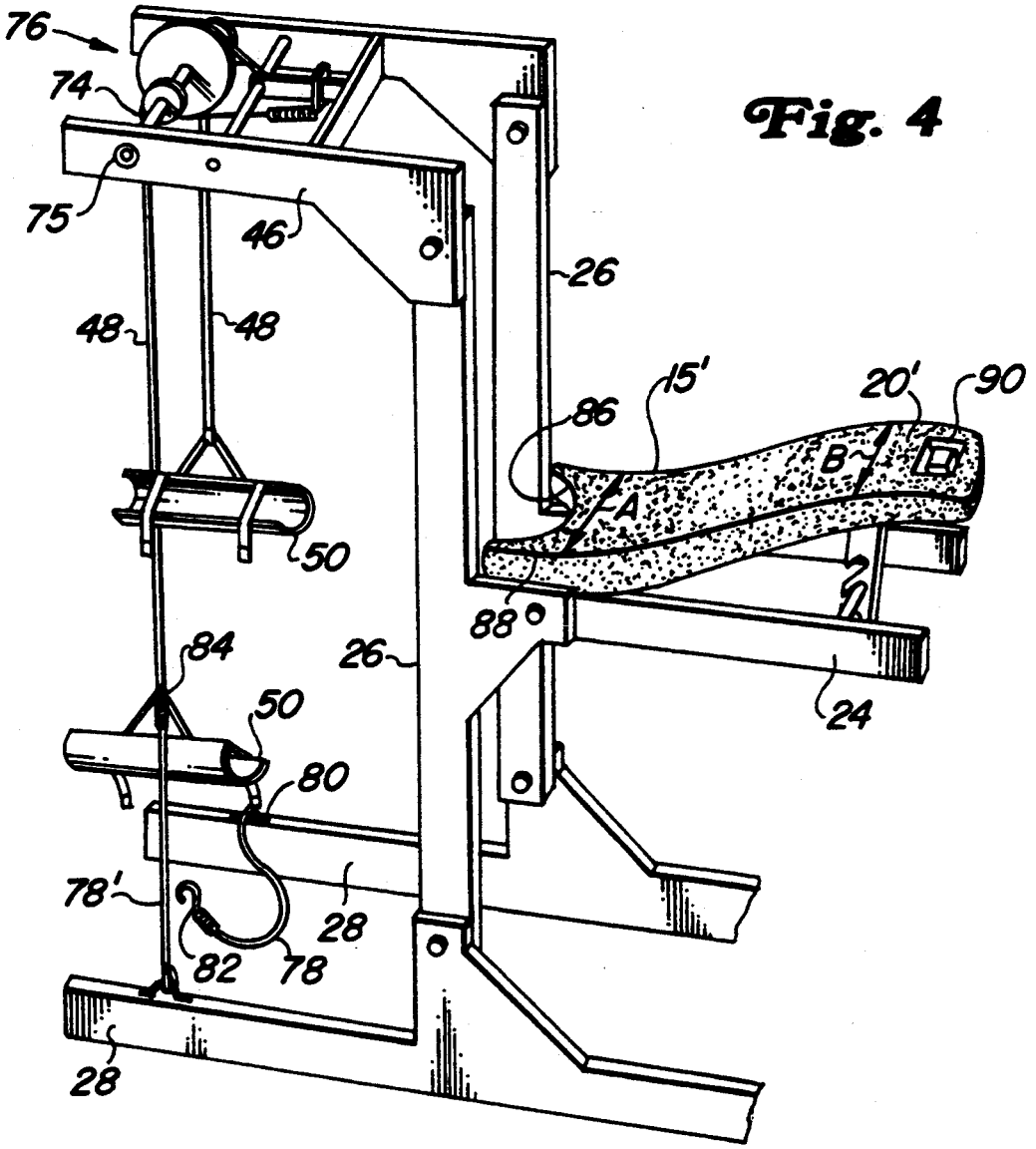
FIG. 4 is a three dimensional view showing the leg resistance mechanism and leg supports.

FIG. 4 depicts a similar arrangement of overrunning clutch assemblies and a flywheel supported by a shaft 74 which provides a preferred device 76 for the downward resistance of leg movement. A pair of bearings and journals 75 hold the ends of shaft 74 in the horizontally extended members 46. The friction device 76 operates in essentially the same manner as that described for friction device 30. The cables 48 may together drive the pulley to which they attach and recoil together as the user's legs are raised or downward leg movement may drive one pulley while upward leg movement allows the other pulley to recoil and collect the slack cable. The upward tension of the recoil mechanism is preferably designed so that its counteracting of gravitational resistance will match the buoyancy provided by water when kicking in actual swimming.

Again the recoil mechanism may keep a small amount of upward tension on the cables 48 and the leg attachments 50. Since this tension can interfere with attachments of the leg attachment to the users legs, means are provided for relieving this tension. FIG. 4 shows a cord 78 attached by a bracket 80 on a rearward portion of a bottom rail 28 and having a hook 82 at the opposite end. When placed in an eyelet 84, as shown by cord 84', the hook 82 provides means for restraining the leg cables by cord 84 holding the leg attachment in a low position. Eyelet 84 is also located above the actual attachment point of cable 48 to attachment 50 to provide slack cable below the eyelet. The slack cable lets the user freely move the leg attachment to facilitate securing attachment 50 to the users legs. Cord 78, hook 82 and eyelet 84 are only one means of restraining the leg cables in an extended position to facilitate attachment of the cables to the users legs or feet. Another suitable means would comprise a stopper assembly such as an eye and quickly positionable clamp on the cable that could be moved to act against the eye when cable tension relief is desired.

FIG. 4 also shows an alternate bench 16' without a user. The back of bench 16' illustrates a U-shaped cutout 86. Cutout 86 can have a depth of about 6 to 12 inches and will normally have a width of about one foot. The sides 88 of the bench next to cutout 86 will typically have a width of from 2 to 4 inches. Thus, back 15' of the bench will preferably have a width of from 16 to 20 inches as indicated by dimension A. Although FIG. 4 shows a U-shaped cut out, the hip cut away may have any shape that allows full hip movement with the vertical bench supports located substantially behind the hips.

Front 20' of the bench normally has reduced width relative to the back of the bench. The reduced width increases the arm freedom of the user. Preferred widths for the front of the bench (dimension B) may be in a range of from 5 to 12 inches. Typical dimensions for the length of the narrow width section at the front of the bench ranges from 15 to 24 inches the bench preferably will have an overall length of from 30 to 48 inches. The bench may be made of any soft material such as padded vinyl or other molded composites which are well known to those skilled in the art.

Figure 5:
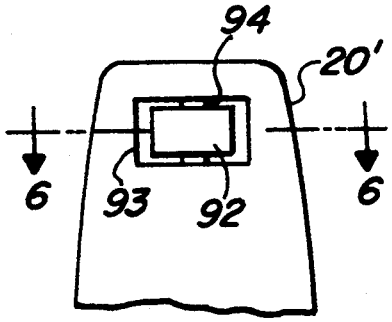
FIG. 5 is partial view of the end of the swim bench of this invention.
Figure 6:
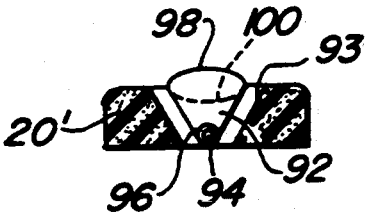
FIG. 6 is a section of the end of the bench shown in FIG. 5.

The front of bench 20' also includes a chin support 90. FIG. 5 shows a plan view of one version of the chin support which consists of a pad 92 pivotally mounted on a shaft 94 and located in an opening 93 defined in front 20' of the bench. The shaft is held by the top and bottom sides of opening 93 so that the pad has an axis of rotation parallel to the longitudinal axis of the bench. Opening 93 may be rectangular in shape so that the pad can slide longitudinally in the slot to adjust the position of the chin support for the length of the user's body. FIG. 6 shows a cross section of the pad and pad support. In order to keep the pad rotationally centered in the opening a coil spring 96 can offer mild resistance to the movement of the pad but offer enough force to keep the pad centered in the opening when the user first puts their head on the pad. Location of shaft 94 below the top of the pad has the advantage of increasing the radius of rotation for the top surface of the pad. This is particularly beneficial in simulating the true motion of the head during swimming. Since the chin rotates about the neck, the chin moves a along a relatively large radius. Locating shaft 94 toward the bottom of the bench, as shown in FIG. 6, increases the radius of rotation so the head does not drop excessively as the head reaches its maximum rotational point. Accordingly the pad supports the user's head and permits gentle rolling of the head from side to side as normally occurs during actual swimming. In addition the pad may have convex surface 98 upon which the chin rests or may have a concave surface 100 to more securely receive the chin. Preferably the chin support pad 92 will be located in the bench as illustrated by FIGS. 5 and 6 but, may be provided in any suitable manner such as a location ahead of the bench on an extended shaft.

Another feature of this invention that aids in a more realistic approximation of swimming is the use of hand attachment in place of the handles shown in FIG. 1. The hand attachment frees the fingers of the user to maintain a more natural swimming position: when swimming, the hands are maintained with the fingers in an extended position. The hand attachment also free the fingers so that tasks, such as adjusting arm tension or wiping the face, can be completed without removing the hand attachment.

Figure 7:
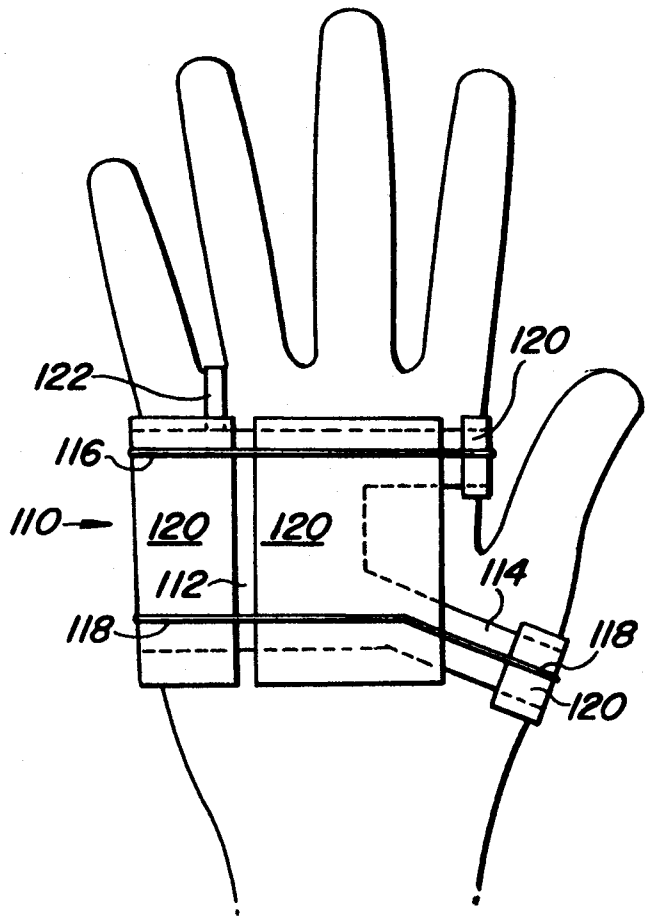
FIGS. 7 and 8 are bottom and top view of a preferred hand attachment.
Figure 8:
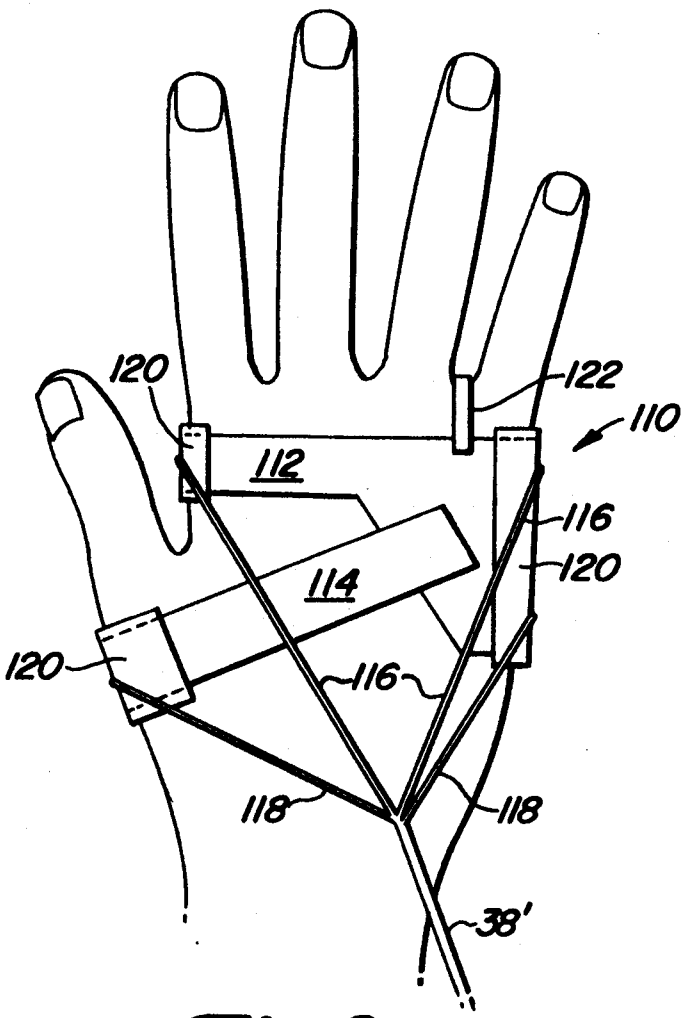

In one form the hand attachment has the arrangement shown in FIGS. 7 and 8. FIG. 7 shows the arrangement of the attachment device over the palm of the users hand 110. The hand attachment has an elastic strap 112 that crosses the palm of the users hand below the thumb and an elastic strap 114 that crosses the user palm below the thumb. A line 116 for attachment to the cable is located over strap 112 and a similar line 118 is located over strap 114. A one piece or multi-piece plastic guard 120 located between the straps and the lines takes any direct pressure from lines 116 and 118 to protect the users hands and holds the lines to distribute the line load to the elastic straps. Optionally a narrow band of material 122 may extend between one or more of the users fingers to prevent the attachment from sliding up the arm during use. FIG. 8 shows the hand attachment on the back of the user hand. Elastic strap 112 completely circles the users hand below the thumb while elastic strap 116 circles around the thumb and attaches to strap 112. Strap 116 may be attached permanently to strap 112 or may be removable attached with Velcro or other suitable fasteners. FIG. 8 also shows attachment of the opposite end of band 122 to strap 112. The end of lines 116 and 118 pass around to the back of the user hand and connect to the end of a cable 38' which is attached to a pulley in the manner previously described.

Figure 9:
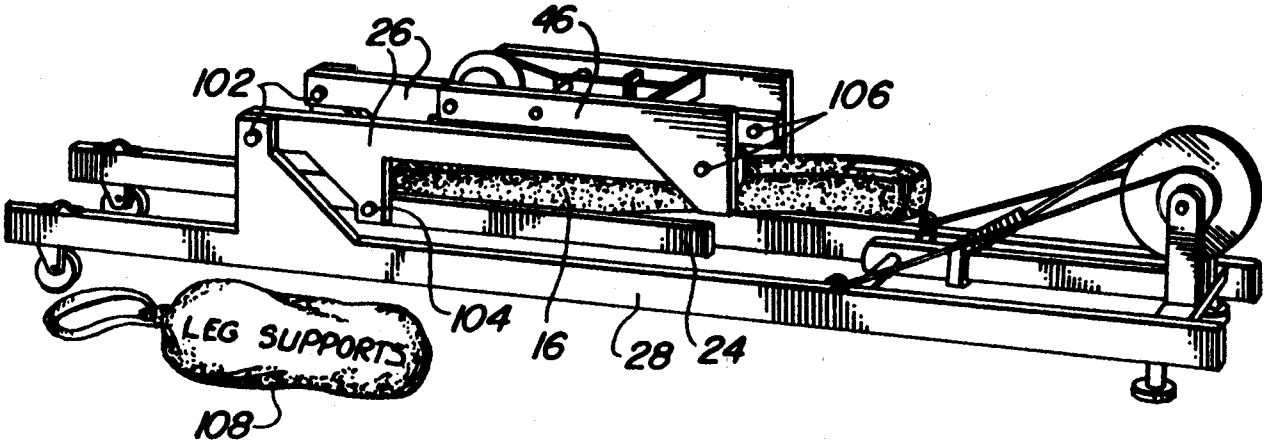
FIG. 9 shows the apparatus of FIG. 1 in a storage configuration.

The exercise apparatus of this invention also lends itself to compact storage. FIG. 9 illustrates the apparatus in a storage position. Changing the apparatus from the exercise position shown by FIG. 1 to storage position if FIG. 9 begins by pivoting horizontal members 24 together with bench 16 upward about a pair of hinges 104 until the horizontal member are substantially parallel with the vertically extendable members 26. Next the vertically extendable members pivot about a pair of hinges 102, located above the bottom rails 28, to point the vertically extendable members 26 forward into substantially parallel alignment with bottom rails 28. Pivoting of the vertically extendable members 26 to the bottom rails 28 bring horizontally extendable members 46 into a vertical position. Horizontally extendable members 46 pivot from the vertical position about a hinge 106 to point in a rearward direction in substantially parallel alignment with both vertically extendable members 26 and bottom rails 28. After all of the extended members have been rotated into the mutually parallel arrangement shown in FIG. 9, the apparatus is extremely compact and easily stored. In order to further aid in storage the leg support may be designed quick detachment from the cables and stored in a canvass bag 108.

I claim:

1. An exercise apparatus for simulating a swimming motion, said apparatus comprising:

a substantially horizontal bench for supporting a person in a prone position having a front and back end;

means for attaching a cable to a user's hands;

a pair of cables attaching each of said means for attaching to a resistance pulley located ahead of the front of said bench to provide abduction resistance to arm movement when a user's arm is extended above the shoulder and extensive resistance to arm movement when the a user's arm is below the shoulders;

a pair of leg supports;

means for providing resistance to downward movement of said leg supports comprising a pair of cable ends depending from a resistance pulley assembly located above the users legs and a pair of sleeves fixed to the ends of said pulley and adapted to receive the lower portion of a users legs and, means for removing tension from said cable ends to facilitate the attachment of the user's leg to said sleeve.

2. The apparatus of claim 1 wherein said sleeve consists of molded plastic adapted to wrap about a users shin.

3. The apparatus of claim 1 wherein said sleeve consists of a canvass material adapted to wrap about a user shin.

4. The apparatus of claim 1 wherein said bench is supported from the back end of said bench by a vertical support to provide cantilevered support for the front end of said bench.

5. The apparatus of claim 1 wherein said means for attaching includes one or more straps for extending around a user's hand and a line secured to said strap with at least one of its end attached to said cable.

6. An exercise apparatus for simulating a swimming motion, said apparatus comprising:

a pair of spaced apart bottom rails a first resistance device secured to a forward portion of said spaced apart bottom rails and comprising a lower resistance sheave mounted on a first shaft, a pair of lower pulleys located on opposite sides of said first shaft, an arm cable connected to each lower pulley, a recoil mechanism to wind the cable around each arm pulley, an overrunning clutch for turning said first shaft in a single direction when unwinding said arm cable; and a means attached to opposite ends of said arm cables for attaching said cable to a user's hands;

a vertically extendable member fixed to a rearward portion of each of said spaced apart bottom rails to provide a pair of vertical rails;

a substantially horizontal bench for supporting a person in a prone position having a back end fixed with respect to said vertical members and a front end, means for adjustably elevating said front end of said bench with respect to said back end of said bench, and the back end of said bench defining a U-shaped cut out for receiving the hips of a user;

a horizontally extendable member fixed to each of the vertically extendable members and adapted to extend in a rearward direction with respect to said spaced apart bottom rails to provide a pair of spaced apart top rails located above said bench; and, a second resistance device secured to a rearward portion of said spaced apart top rails comprising an upper resistance sheave mounted on a second shaft, a pair of upper pulleys located on opposite sides of said second shaft, a leg cable connected to each upper pulley, a recoil mechanism to wind the leg cable around each leg pulley, an overrunning clutch for turning said second shaft in a single direction when unwinding said leg cable; and a pair of leg supports attached to opposite ends of said leg cables for attachment to the lower leg or foot of the user.

7. The apparatus of claim 6 wherein a chin support is located in a forward portion of said bench, adapted to receive a users chin and pivotally fixed with respect to said bench.

8. The apparatus of claim 6 wherein a horizontally extendable member is fixed to a central portion of each of said vertically extendable members adapted to extend in a forward direction with respect to said spaced apart bottom rails to provide a pair of spaced apart middle rails for supporting said bench in a cantilever manner.

9. The apparatus of claim 6 wherein said vertically extendable members are pivotally supported with respect to said spaced apart bottom rails and said spaced top rails are pivotally supported with respect to said vertically extendable members such that said bottom rails, top rails and vertically extendable members are rotatable into a mutually parallel arrangement.

10. The apparatus of claim 6 wherein means are provided for restraining said leg cables in an extended position to facilitate attachment of said cables to the users legs or feet.

11. The apparatus of claim 6 wherein said means for restraint comprises a restraint cable having one end attached to a rearward portion of one of said bottom rails and the other end having means for attaching to said leg cable or leg support.

12. The apparatus of claim 6 wherein said means for attaching said cable includes one or more straps for extending around a user's hand and a line secured to said strap with at least one of its end attached to said cable.

13. An exercise apparatus for simulating a swimming motion, said apparatus comprising:

a bottom support;

a first resistance device secured to a forward portion of said bottom support and comprising a resistance sheave mounted on a first shaft, a pair of arm pulleys located on opposite sides of said first shaft, an arm cable connected to each arm pulley, a recoil mechanism to wind the cable around each arm pulley, an overrunning clutch for turning said first shaft in a single direction when unwinding said arm cable; and a means attached to opposite ends of said arm cables for attaching said cable to a user's hands;

a vertically extendable member fixed to a rearward portion of each of said bottom support to provide a pair of vertical rails;

a substantially horizontal bench for supporting a person in a prone position having a back end fixed with respect to said vertical members;

a horizontally extendable member fixed to said vertically extendable member and adapted to extend in a rearward direction with respect to said bottom support to provide a top rail located above said bench; and, a second resistance device secured to a rearward portion of said spaced apart top rails comprising a resistance sheave mounted on a second shaft, a pair of upper pulleys located on opposite sides of said second shaft, a leg cable connected to each upper pulley, a recoil mechanism to wind the leg cable around each leg pulley, an overrunning clutch for turning said second shaft in a single direction when unwinding said leg cable, and a pair of leg supports attachment to opposite ends of said leg cable for attachment to the lower leg or foot of the user.

14. The apparatus of claim 13 wherein a chin support is located in a forward portion of said bench, adapted to receive a users chin and pivotally fixed with respect to said bench;

15. The apparatus of claim 13 wherein said vertically extendable member is pivotally supported with respect to said bottom support and said top rails is pivotally supported with respect to said vertically extendable member such that said bottom support, top rail and vertically extendable member are rotatable into a mutually parallel arrangement.

16. The apparatus of claim 13 wherein means are provided for restraining said leg cables in an extended position to facilitate attachment of said cables to the users legs or feet.

17. The apparatus of claim 16 wherein said means for restraint comprises a restraint cable having one end attached to a rearward portion of said bottom support and the other end having means for attaching to said leg cable or leg support.

18. The apparatus of claim 17 wherein said means for attaching said cable includes one or more straps for extending around a user's hand and a line secured to said strap with at least one of its ends attached to said cable.

* * * * *